US010641545B2

(12) United States Patent
Signorino et al.

(10) Patent No.: US 10,641,545 B2
(45) Date of Patent: May 5, 2020

(54) DOMESTIC REFRIGERATION DEVICE, AND METHOD OF CONTROLLING A LIGHT SOURCE ARRANGEMENT ARRANGED THEREIN

(71) Applicant: emz-Hanauer GmbH & Co. KGaA, Nabburg (DE)

(72) Inventors: Manfredi Signorino, Wackersdorf (DE); Martin Brabec, Nabburg (DE); Daniel Sygnat, Pfreimd (DE); Johann Schenkl, Bodenwoehr (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 16/205,680

(22) Filed: Nov. 30, 2018

(65) Prior Publication Data

US 2019/0170432 A1 Jun. 6, 2019

(30) Foreign Application Priority Data

Dec. 1, 2017 (DE) ..... 10 2017 011 134

(51) Int. Cl.

| | |
|---|---|
| ***F25D 27/00*** | (2006.01) |
| ***H05B 33/08*** | (2020.01) |
| ***F25D 25/02*** | (2006.01) |
| ***F21V 33/00*** | (2006.01) |

(52) U.S. Cl.

CPC ..... *F25D 27/005* (2013.01); *F21V 33/00* (2013.01); *F25D 25/025* (2013.01); *H05B 33/0803* (2013.01); *H05B 33/0869* (2013.01)

(58) Field of Classification Search

CPC ..... F25D 27/00; F25D 27/005; H05B 33/086; H05B 33/0866; H05B 33/0869; G09F 19/12

See application file for complete search history.

(56) References Cited

U.S. PATENT DOCUMENTS

| | | | |
|---|---|---|---|
| 7,360,374 | B2 | 4/2008 | LaRose, Jr. |
| 9,696,009 | B2 | 7/2017 | LaRose |

(Continued)

FOREIGN PATENT DOCUMENTS

| | | | |
|---|---|---|---|
| CN | 202993741 | U | 6/2013 |
| DE | 102013211097 | A1 | 12/2014 |

(Continued)

OTHER PUBLICATIONS

German Patent Office Search Report in Germany counterpart application, dated Sep. 11, 2018.

*Primary Examiner* — Jason Crawford

(74) *Attorney, Agent, or Firm* — Robert R. Deleault, Esq.; Mesmer & Deleault, PLLC

(57) ABSTRACT

A domestic refrigeration device comprises an interior for storing foods, a light source arrangement which is configured to emit light, in particular white light, of different spectral characteristics into the interior, and a sensor unit which is configured to optically detect light emitted by the lit interior, to allocate to the detected light a value that is characteristic of the color of the emitted light, and to control the light source arrangement in such a manner that light of a specific spectral characteristic, which is dependent on the value that is characteristic of the color, is emitted.

20 Claims, 6 Drawing Sheets

(56) References Cited

U.S. PATENT DOCUMENTS

| | | | | |
|---|---|---|---|---|
| 2008/0012722 | A1* | 1/2008 | Moseley | H05B 33/0863 340/12.22 |
| 2008/0151535 | A1 | 6/2008 | de Castris | |
| 2008/0212314 | A1* | 9/2008 | Swofford | A47F 3/001 362/126 |
| 2008/0219002 | A1* | 9/2008 | Sommers | A47F 3/001 362/247 |
| 2009/0212313 | A1* | 8/2009 | Platzer | A47F 11/10 257/98 |
| 2009/0296383 | A1* | 12/2009 | Valster | A47F 11/10 362/231 |
| 2011/0005258 | A1* | 1/2011 | Audet | F25D 27/005 62/264 |
| 2011/0058353 | A1* | 3/2011 | Yang | A47F 3/001 362/84 |
| 2014/0268862 | A1* | 9/2014 | Gooden | F25D 27/00 362/555 |
| 2015/0035432 | A1* | 2/2015 | Kendall | H05B 33/0854 315/76 |
| 2015/0276305 | A1* | 10/2015 | Hammond | F25D 25/025 362/92 |
| 2018/0017317 | A1* | 1/2018 | Adachi | F21K 9/64 |
| 2018/0027637 | A1* | 1/2018 | Kurt | H05B 33/0857 315/159 |
| 2019/0137092 | A1* | 5/2019 | Schenkl | H05B 33/0857 |

FOREIGN PATENT DOCUMENTS

| | | | |
|---|---|---|---|
| DE | 102013213206 | A1 | 1/2015 |
| DE | 102014017044 | A1 | 5/2015 |
| WO | 2007068645 | A1 | 6/2007 |

* cited by examiner

DOMESTIC REFRIGERATION DEVICE, AND METHOD OF CONTROLLING A LIGHT SOURCE ARRANGEMENT ARRANGED THEREIN

BACKGROUND OF THE INVENTION

1. Field of the Invention

The present invention relates generally to a domestic refrigeration device, in particular a refrigerator, having a light source arrangement. The invention relates also to a method of controlling the light source arrangement.

2. Description of the Prior Art

In food shops, it is generally required to light the foods that are offered, such as meat, fish, fresh vegetables, cheese and bread, by means of light sources which are especially suitable therefor, in order to ensure that the foods appear as appealing as possible. It is conventional to use light sources which emit light of different spectral characteristics for different foods. For example, it is possible to use colored light sources and white light sources, but also white light sources with different correlated color temperatures, that is to say white light sources which emit, for example, a warm white with a color temperature less than 3300 K or which emit a daylight white with a color temperature greater than 5000 K. Relatively "warm" light sources are generally used for foods such as fruits, vegetables and baked goods, and relatively "cool" light sources are used for foods such as meat and fish. Since in food shops the individual foods are each presented at fixed, predetermined locations within the food shop, the individual light sources are also fixedly mounted at those locations, and nor is there any requirement to change this.

In domestic refrigeration devices too, such as in refrigerators, it is generally required that the interior of the refrigerator, in which the foods that are to be kept cool are stored, should be lit when the user opens a door of the refrigerator allowing access to the interior. The lighting is on the one hand to make it easier for the user to see the foods stored in the refrigerator, but on the other hand it is also to present the foods to the user in a particularly appealing manner. Known lighting solutions generally use fixedly positioned light sources having a specific radiation characteristic, which is independent of the type of foods being lit in the refrigerator at that time. Thus, with the known lighting solution, the foods in the refrigerator are visible but, because the lighting is independent of the foods in the refrigerator, the appearance of the lit foods is at one time more and at another time less appealing.

SUMMARY OF THE INVENTION

It is an object of the invention to eliminate disadvantages known from the prior art. In particular, it is an object of the invention to allow, in a simple and inexpensive manner, the foods stored in a domestic refrigeration device not only to be readily visible to the user of the domestic refrigeration device but also to be presented at all times with as appealing an appearance as possible.

The present invention achieves these and other objectives by providing, in one embodiment, a domestic refrigeration device which comprises an interior for storing foods, a light source arrangement which is configured to emit light, in particular white light, of different spectral characteristics into the interior, and a sensor unit which is configured to optically detect light emitted by the lit interior, to allocate to the detected light a value that is characteristic of the color of the emitted light, and to control the light source arrangement in such a manner that light of a specific spectral characteristic, which is dependent on the value that is characteristic of the color, is emitted. In the case of the described domestic refrigeration device, it is thus possible automatically to change a spectral characteristic of the illuminating light in dependence on the color of the displayed contents of the interior. In particular, it is possible, via the color, to draw conclusions about the possible contents of the interior. The dependence of the spectral characteristic of the illuminating light and the value that is characteristic of the color of the emitted light is typically specified beforehand.

The value that is characteristic of the color of the emitted light can be a value for the hue of the emitted light in the HSV color space. The value for the hue specifies the dominant wavelength of the color. Thus, the spectral characteristic of the illuminating light can be chosen and adjusted on the basis of the predominant color impression.

In particular, the light emitted by the light source arrangement can be white light with different correlated color temperatures. In the embodiment, the correlated color temperature (CTT) of the white light source is thus changed in dependence on the value that is characteristic of the color. The correlated color temperature describes the relative color temperature of a white light source. The grades of white range from cool white through neutral white to warm white. The color fields, or color locations, for the correlated color temperature lie on both sides of the radiation curve for black radiators of different temperatures (black-body curve) in the CIE color space. The white light can be achieved, for example, via a red, a yellow and a blue light source, in each case typically an LED. Alternatively, a blue/yellow light source, for example, can be used as the white light source, for example via an ultraviolet or blue radiating UV-LED which is coated with a yellow fluorescent phosphor. A red light source can also be added to the blue/yellow light source in order to enhance the warm component. The correlated color temperature of a light source arrangement can be achieved by changing the relative intensities of the different colored light sources.

The light source arrangement can be so configured that it emits light into a partial volume of the interior that is in the form of a separate storage region. In one embodiment, the separate storage region can be brought from a closed state into an open state and vice versa. The sensor unit can thereby further comprise a position sensor, in particular a Hall sensor or reed sensor, for detecting the closed state and the open state of the separate storage region. It can thus be determined, by means of the position sensor, whether the contents of the separate storage region may have changed and accordingly the lighting characteristic may have to be adapted to the new contents, that is to say whether the value that is characteristic of the color has to be determined. The contents of the separate storage region may have changed whenever the detection of a closed state takes place shortly after the detection of an open state of the separate storage region.

In one form of construction, the separate storage region can be a cold compartment, in particular for fresh foods, which is arranged to be displaceable between an open state and a closed state, wherein in the closed state of the cold compartment a base plate on which the light source arrangement and the sensor unit are provided is arranged above an open side of the cold compartment and spaced apart from the open side of the cold compartment. The base plate can serve as a shelf for foods, so that in this solution the light source arrangement and the sensor unit are integrated into existing components of the domestic refrigeration device.

In order to ensure that the cold compartment is lit as evenly and as reliably as possible, the light source arrangement can be arranged along a longitudinal direction of the base plate narrow side and inclined relative to the base plate narrow side in the direction towards the separate storage compartment. The base plate narrow side is, in particular, an end face of the base plate. The sensor unit can be arranged on a base plate flat side facing the cold compartment.

If the base plate has a screen into which the light source arrangement is integrated, and to which the sensor unit can also be fixed, the screen can advantageously be removably fixed to the base plate. The base plate is accordingly easy to clean.

In order to ensure good lighting of the cold compartment and at the same time protection for the light source arrangement, the screen can have a curved reflector portion opposite the light source arrangement. The reflector portion reflects, or scatters, the light emitted by the light source arrangement in the direction towards the cold compartment and protects the light source arrangement from external mechanical influences.

In one embodiment, the light source arrangement has a plurality of light sources, in particular light-emitting diodes, LEDs, which emit light of different wavelengths, and the sensor arrangement has a light sensor which is sensitive in the different wavelengths. In order to achieve maximum color sensitivity, the LEDs, or light sources, are activated in such a manner that they emit light temporally in succession. In particular, the light-emitting diodes are so matched to one another that they emit a white light.

In another embodiment, the sensor unit has a microcamera for optically detecting the lit interior. Here too, the light source arrangement can be any desired light source, in particular white light source.

There is further provided a method of controlling a light source arrangement, wherein the light source arrangement is arranged in a domestic refrigeration device, in particular in a domestic refrigeration device as described above, which comprises an interior for storing foods, and the light source arrangement is configured to emit light, in particular white light, of different spectral characteristics into the interior. The method comprises the step of lighting the interior by means of the light source arrangement with light, in particular white light, optically detecting the light emitted by the lit interior, determining a value that is characteristic of the color of the emitted light, and controlling the light source arrangement in such a manner that light of a specific spectral characteristic, which is dependent on the value that is characteristic of the color, is emitted.

The value that is characteristic of the color of the emitted light can again be a value for the hue of the emitted light in the HSV color space. In order then to control the light source arrangement in such a manner that light of a specific spectral characteristic is emitted, in dependence on the value for the hue of the emitted light, the method can comprise the following steps: allocating the determined value for the hue to one of a plurality of color value groups, wherein a color value group in each case comprises one or more color value ranges, each color value group having color value ranges which are different from one another, and wherein each color value group is in turn allocated to a specific correlated color temperature, and activating the light source arrangement in such a manner that light with a correlated color temperature that corresponds to the correlated color temperature allocated to the color value group to which the determined value for the hue was allocated is emitted. In this variant, the correlated color temperature of the emitted light is thus changed. In particular, in this variant, the different color value groups, which contain different color value ranges, are each allocated to a correlated color temperature. This allocation is specified beforehand. Accordingly, it is possible, for example, to light foods of different color impressions, such as vegetables and milk products, that is to say in which the color impression is dominated by a different color in each case, with light of the same correlated color temperature.

The invention will be explained in greater detail below with reference to the accompanying drawings.

DETAILED DESCRIPTION OF THE INVENTION

Figure 1:
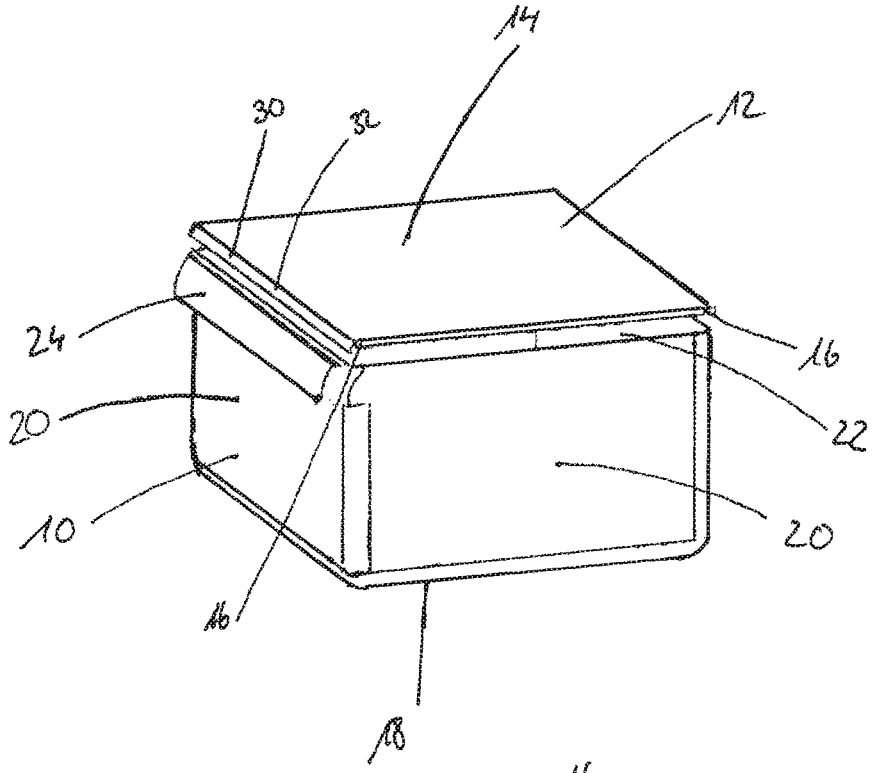
FIG. 1 is a schematic perspective view of a cold compartment which is to be arranged and lit in a refrigerator, with a plate arranged thereabove which can serve as a shelf for foods.

It is assumed in the following that the cold compartment designated 10 in the figure is intended to be arranged in a refrigerator. The refrigerator, which is not shown, has an interior which serves as the cold chamber for the cold storage of foods. The interior is delimited at the sides by two side walls, at the back by a rear wall, at the bottom by a bottom wall and at the top by a top wall. At the front there is provided a pivotably arranged door for opening and closing the refrigerator. The cold compartment 10 forms a separate storage region of the interior.

It is further assumed that the cold compartment 10 is displaceably arranged on the bottom wall of the refrigerator. Above the cold compartment 10 there is arranged a base plate 12, which can form a shelf for foods. The base plate 12 is typically displaceably fixed in a groove extending in the depth direction in the refrigerator and formed by in each case two adjacent projections provided on a side wall. The base plate 12 has two base flat sides 14, the upper side face, which serves as a shelf for foods, and the lower side face facing the cold compartment. At the periphery, the base plate has four narrow sides 16.

The cold compartment 10 is in the form of a drawer having a bottom wall 18, four side walls 20 and an open side 22 opposite the bottom wall 18. The front side wall 20 facing the user of the refrigerator has a handle 24 for utilising the cold compartment 10. The base plate 12 is arranged in the refrigerator above the cold compartment 10 and spaced apart from the open side 22 of the cold compartment 10, so that the cold compartment 10 can be moved without moving the base plate 12. The distance of the base plate 12 from the open side 22 of the cold compartment 10, or from the upper edges of the four side walls 20 of the cold compartment 10, is small and is typically not more than 1 cm, more preferably less than 1 cm.

FIG. 1 shows a closed state of the cold compartment 10, in which the base plate 12 substantially covers the open side 22 of the cold compartment 10, as described above, that is to say to be arranged as to be substantially congruent with the open side 22. As is likewise described above, the cold compartment 10 is displaceably arranged in the refrigerator and, when the refrigerator is open, can be displaced in the direction towards the open front side of the refrigerator and thus brought into an open state. In the open state, the cold compartment 10 is thus displaced relative to the base plate 12, so that at least a portion of the open side 22 is not covered by the base plate 12. In the open state of the cold compartment 10, food can be removed from the cold compartment 10 and it can be filled again with fresh food. The state of the cold compartment 10 can be detected by means of a position sensor, as is described below. If it is determined, by means of the position sensor, that the cold compartment 10 has been moved from the open state into the closed state, the cold compartment 10 and the contents thereof are optically detected and evaluated, as is likewise described in greater detail below, so that conclusions can be drawn regarding the type of food stored in the cold compartment 10.

Figure 2:
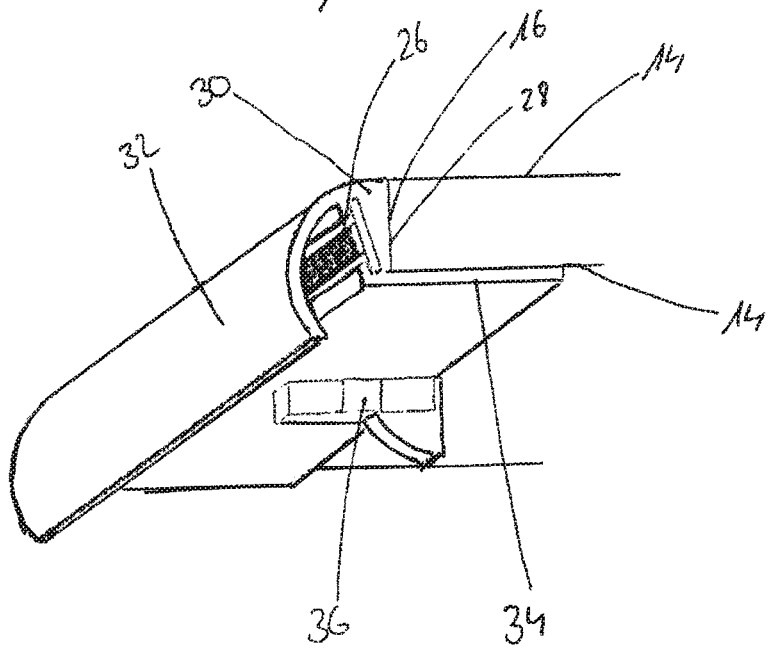
FIG. 2 is a perspective detailed view of the front region of the plate arranged above the cold compartment of FIG. 1.

As can be seen in the enlarged view of the front region of the base plate 12 of FIG. 2, a light source arrangement 26 is provided along the front base plate narrow side 16 facing the user. The light source arrangement 26 is so arranged that the light emitted thereby passes into the cold compartment 10 to light the contents of the cold compartment. By being correspondingly activated, the light source arrangement 26 is able to emit light, in particular white light, of different spectral characteristics. For example, the light source arrangement 26 can be activated in such a manner that it emits a "warm" white with a correlated color temperature of, for example, approximately 3000 K or a "cool" white with a correlated color temperature of, for example, approximately 4000 K.

In the embodiment shown in FIG. 2, the base plate has on its front base plate narrow side 16, that is to say the end face 28, a screen 30 into which the light source arrangement 26 is integrated. Opposite the light source arrangement 26, the screen forms a curved portion 32, which serves to reflect and/or scatter the light emitted by the light source arrangement 26 in the direction towards the cold compartment 10 located beneath. To that end, the curved portion 32 of the screen 30 is open to the bottom, that is to say in the direction towards the cold compartment 10.

The screen 30 also extends over a portion of the lower base plate flat side 14, namely over a front region, adjoining the base plate narrow side 16, of the lower base plate flat side 14. A sensor unit 36 is arranged in this region 34 of the screen 30 parallel to the base plate flat side 14. The sensor unit 36 is so configured and arranged that it can optically detect the interior of the cold compartment 10 lit by the light source arrangement 26, evaluate it and, in dependence on the result of the evaluation, activate the light source arrangement 26 in such a manner that light of a specific spectral characteristic, dependent on the result of the evaluation, is emitted. Further details are given hereinbelow.

Figure 3:
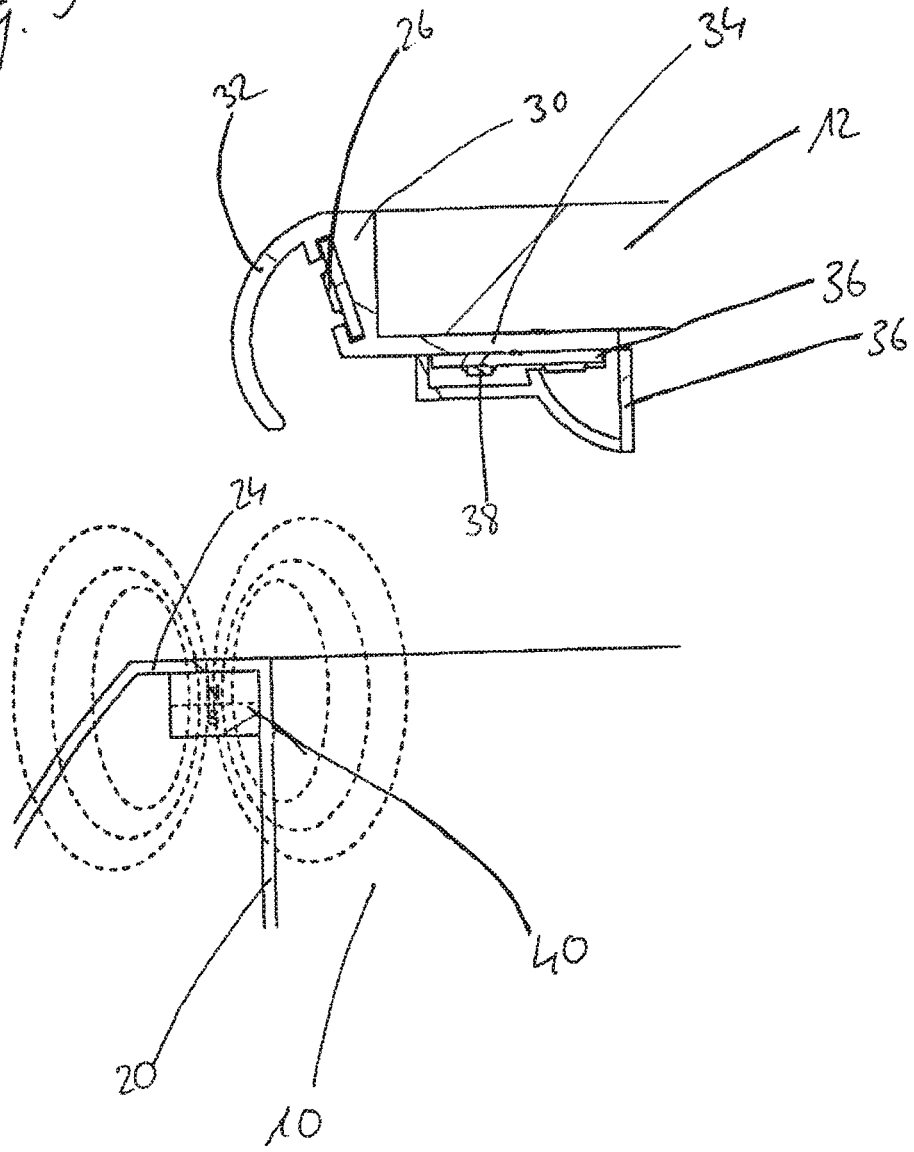
FIG. 3 is a schematic sectional view of an embodiment of the front region of the plate arranged above the cold compartment with a position sensor which cooperates with the field of a permanent magnet on the cold compartment.

In the sectional view shown in FIG. 3, the sensor unit 36 further has a position sensor 38 in the region 34 of the screen 30 parallel to the base plate flat side 14, which position sensor is configured to determine the relative position of the cold compartment 10 relative to the base plate 12. In this manner it is possible to determine whether the cold compartment 10 is in an open state or in a closed state. In particular, it is possible to determine whether the cold compartment 10 has been moved from an open state into the closed state.

The position sensor 38 can be, for example, a Hall sensor or a reed sensor. In order to be able to determine the relative position of the cold compartment 10, the cold compartment 10 is in one embodiment provided with a permanent magnet 40, the magnetic field of which cooperates with the position sensor 38. The permanent magnet 40 can be mounted, as is shown in FIG. 3, in the region formed by the handle 24 and the front side wall 20 of the cold compartment 10.

Figure 4A:
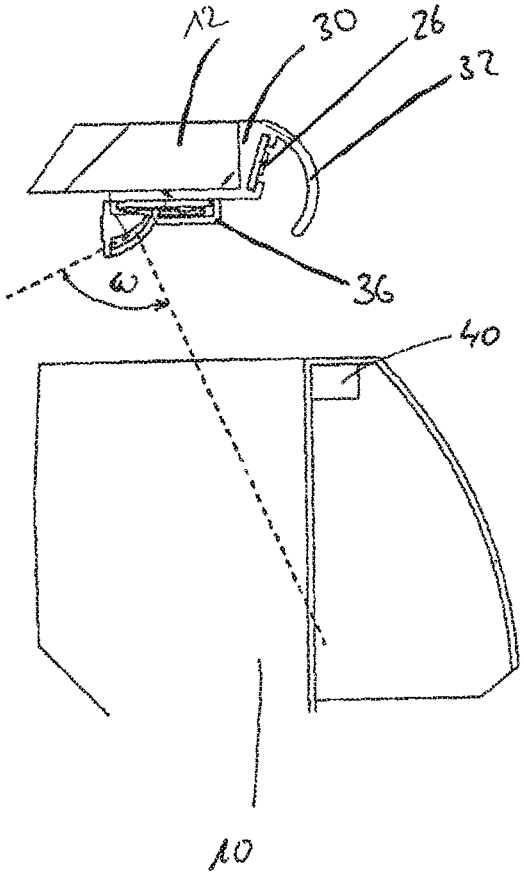
FIG. 4*a* is a schematic sectional view of an embodiment of a combination of a light source arrangement and a sensor unit cooperating therewith.
Figure 4B:
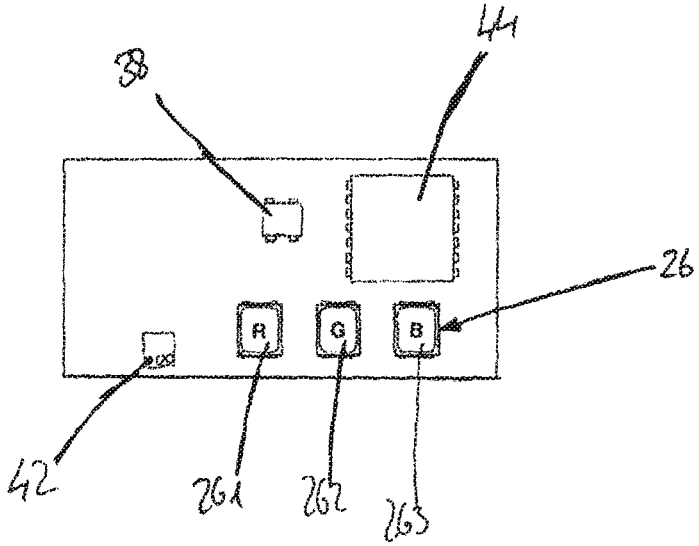
FIG. 4*b* shows, schematically, the individual components of the combination shown in FIG. 4*a*.

According to an embodiment shown in FIGS. 4*a* and 4*b*, the light source arrangement 26 has a plurality of light-emitting diodes (LEDs), each of which emits light with a different wavelength. In particular, the light source arrangement 26 here has an arrangement of three different LEDs 261, 262, 263, an LED 261 which emits red light, an LED 262 which emits green light and an LED 263 which emits blue light. The sensor unit 36 arranged on the lower base plate flat side 14 has an RGB color sensor 42, a position sensor 38, which is typically in the form of a Hall sensor or reed sensor, and a microcontroller 44. The permanent magnet 40 cooperating with the position sensor 38 can be seen schematically in FIG. 4*a*. The RGB color sensor 42 can be, for example, a photodiode which is sensitive in the green, red and blue spectral range. The RGB sensor 42 is provided to optically detect the light emitted by the lit interior of the cold compartment 10. To that end, as will be explained in greater detail hereinbelow, the individual LEDs 261, 262, 263 of the LED arrangement 26 are activated individually in succession, so that the light detected by the RGB sensor 42 corresponds either to light in the red wavelength range, to light in the blue wavelength range or to light in the green wavelength range. The values determined by the RGB sensor 42, which are representative of the intensity of the light detected in the respective wavelength range, are then allocated in combination to a color value by the microcontroller 44. Since conclusions can be drawn via the color value regarding the type of foods stored in the cold compartment 10, the LED arrangement 26 can then be activated, for example by the microcontroller 44, in such a manner that light with a correlated color temperature adapted to the stored foods is emitted.

In FIG. 4*b*, the RGB sensor is shown in combination with the red, blue and green LEDs. However, the RGB sensor can also be combined with any other light source arrangement, in particular white light source arrangement, such as, for example, the above-described light source arrangements with a blue/yellow light source, optionally combined with an additional red light source.

FIG. 4*a* also shows schematically the relative position of the base plate 12 having the sensor unit 36 relative to the cold compartment 10 located therebeneath in the closed state of the cold compartment 10. Also shown is the detection angle ω of the RGB sensor 42, which in the embodiment shown here is approximately 45°.

Figure 5A:
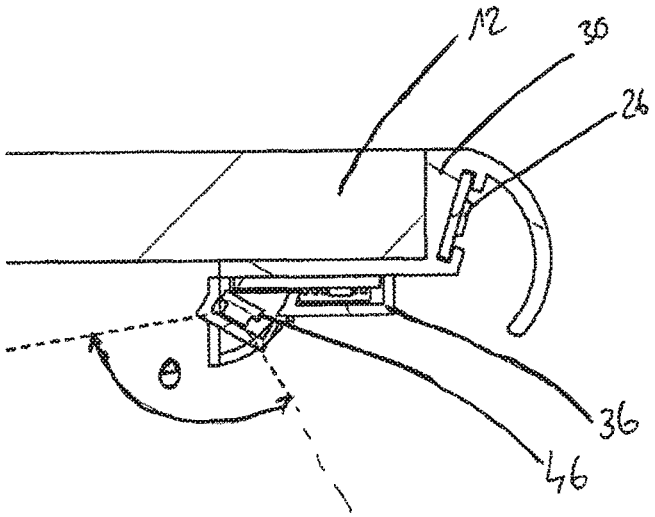
FIG. 5*a* is a schematic sectional view of a further embodiment of a combination of a light source arrangement and a sensor unit cooperating therewith.
Figure 5B:
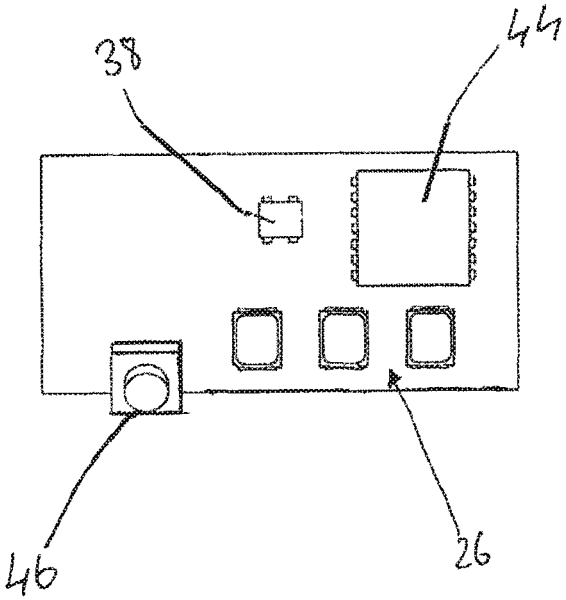
FIG. 5*b* shows, schematically, the individual components of the combination shown in FIG. 5*a*.

The further embodiment shown in FIGS. 5*a* and 5*b* differs from the embodiment shown in FIGS. 4*a* and 4*b* in that, instead of the RGB sensor 42 of FIG. 4*b*, a microcamera 46 is provided for optically detecting the light emitted by the lit interior. The microcamera 46 is part of the sensor unit 36. The light source arrangement 26 can again be any desired light source, in particular any desired white light source, provided that the light source emits light in a wavelength range in which the microcamera 46 is sensitive. The light source arrangement 26 can in particular also be formed by the LEDs 261, 262, 263 of FIG. 4*b*. In combination with the microcamera 46, however, the LEDs are usually activated in such a manner that they emit light of different wavelengths, that is to say red, blue and green light, simultaneously. The image recorded by the microcamera 46 is then evaluated by the microcontroller 44. In particular, as will be explained in greater detail hereinbelow, an average red value, an average green value and an average blue value of the image recorded by the microcamera 46 are determined, which then each form a color value in the RGB color space. In FIG. 5*a*, the viewing angle θ of the microcamera 46 can additionally be seen, which in the embodiment shown here is greater than 90°.

Figure 6:
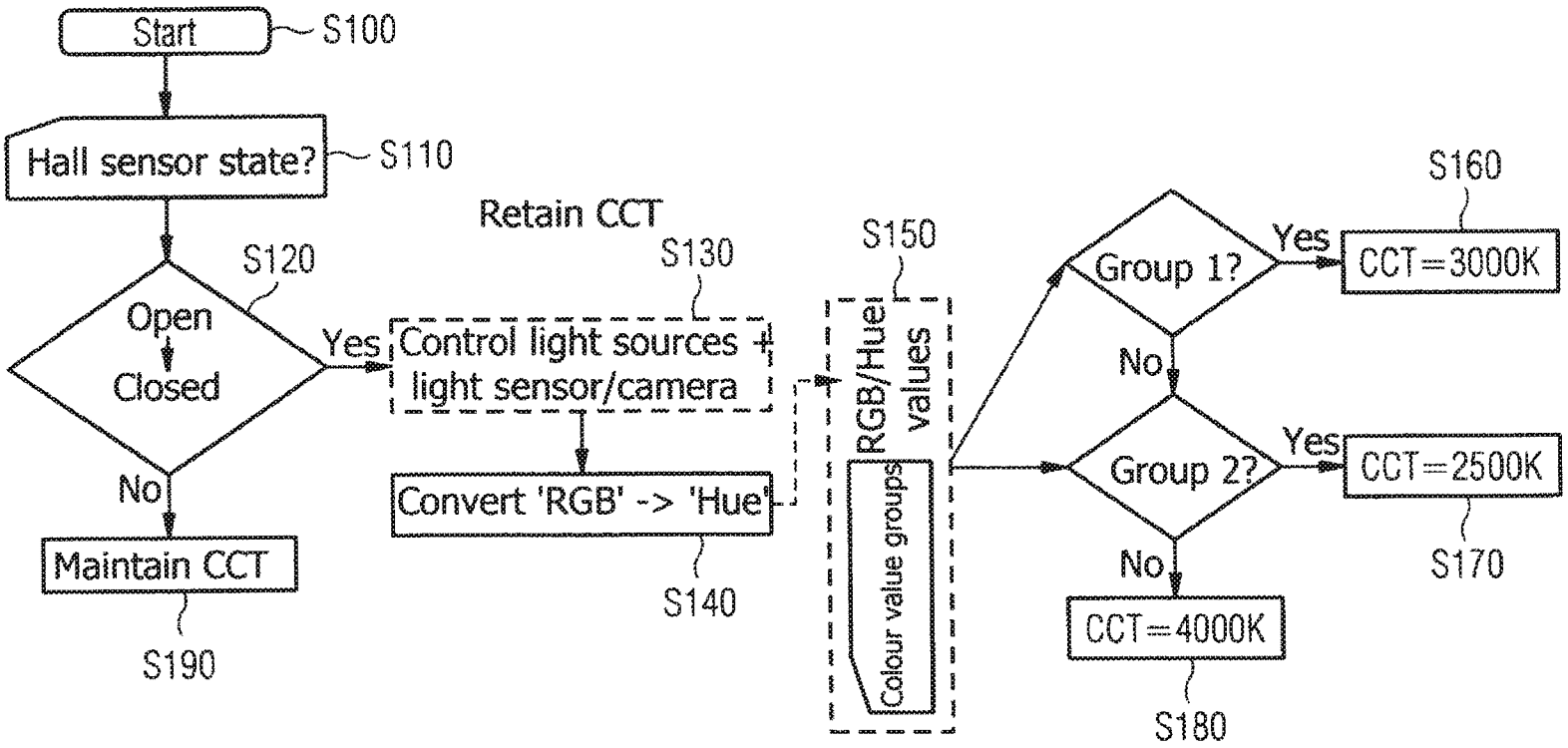
FIG. 6 shows, schematically, the individual method steps of an embodiment of a method of controlling the light source arrangement.

FIG. 6 shows the individual steps of the method of controlling the light source arrangement 26 in the domestic refrigeration device described hereinbefore, wherein it is again to be assumed in the following that it is a refrigerator. The described method begins with step S100, as soon as it is determined by means of the position sensor 38 that the separate storage region of the refrigerator interior moves from the closed state into an open state, that is to say when, with the refrigerator door open, the separate storage region, which is again assumed in the following to be the cold compartment 10, is removed by the refrigerator user. In particular, the state of the cold compartment outputted by the position sensor is checked in step S110 as to whether, following detection of the state "cold compartment open", the state "cold compartment closed" is detected by the position sensor shortly thereafter, that is to say within a predetermined period of time, which, for example, may be not longer than 1 minute. If it is determined in step S120 that such a change in state of the cold compartment 10 is present, the method of determining a color value begins with step S130. In step S130, the sensor unit, in particular the above-described RGB sensor or the microcamera, is caused, by corresponding activation of the microcontroller, to optically detect the lit interior, here the cold compartment. In the case of the RGB sensor, the individual LEDs of the LED arrangement, or the individual light sources of the light source arrangement, are activated individually in succession, so that the light detected by the RGB sensor corresponds either to light in the red wavelength range, to light in the blue wavelength range or to light in the green wavelength range. The values outputted by the RGB sensor, which are representative of the intensity of the light detected in the respective wavelength range, are then further processed and evaluated by the microcontroller. In particular, the individual color intensities, that is to say the intensity of the red light, the intensity of the blue light and the intensity of the green light, are each allocated to a color value. In one embodiment, the three color values are first determined in the RGB color space, wherein each color value can correspond to a value of from 0 to 255. As is known, a color is defined in the RGB color space by in each case a red value, a green value and a blue value.

Then, in step S140, the color defined by the three color values in the RGB color space is converted into the HSV color space. In particular, a value for the hue is determined. How such a conversion is to be carried out is known and is described by way of example hereinbelow.

Thereafter, in step S150, the determined color value for the hue is allocated to one of a plurality of color value groups. A color value group comprises one or more color value ranges, each color value group having color value ranges which are different from one another. The determined color value is allocated to the color group which has a color value range which comprises the determined color value. Each color value group is in turn allocated to a particular correlated color temperature.

In the embodiment shown, there are three color value groups. If the determined color value is allocated in step S150 to the first group ("Group 1"), the light source arrangement is activated in step S160 in such a manner that it emits light with a correlated color temperature of 3000 K. If the determined color value is allocated in step S150 to the second group ("Group 2"), the light source arrangement is activated in step S170 in such a manner that it emits light with a correlated color temperature of 2500 K. Finally, if the determined color value is not allocated in step S150 to either the first or the second group, it is allocated to a third group to which a correlated color temperature of 4000 K is allocated, and the light source arrangement is activated accordingly in step S180.

If the light source arrangement is provided by LEDs which emit light of different wavelengths, the color temperature, that is to say the color impression to the human eye, is determined inter alia by the relative intensities of the differently colored light. By changing the relative intensities, the color temperature of the light emitted by the LEDs can thus be changed.

Figure 7:
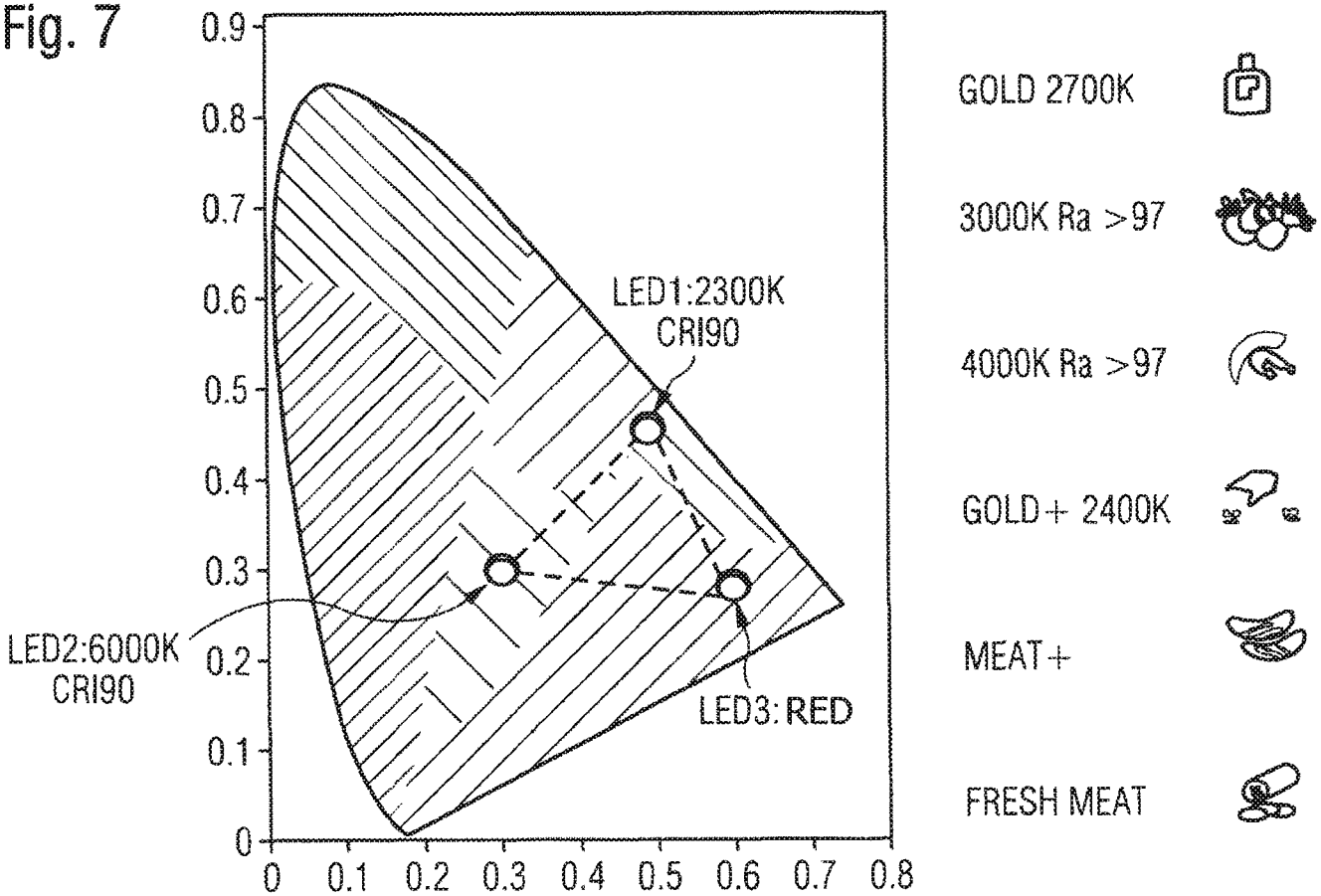
FIG. 7, for purposes of clarity, shows a color triangle determined by three LEDs, in the RGB color space in the CIE standard chromaticity diagram.

This is illustrated again by means of FIG. 7. FIG. 7 shows the RGB color space in the CIE standard chromaticity diagram. By means of the LEDs, "colored" light within the depicted color triangle can be emitted. The figure also shows schematically light of which correlated color temperature can be chosen for which foods in one embodiment. As is known, in order to determine the (correlated) color temperature, the color location of the light source in the color space is first determined and compared with the color locations of black radiators of different temperatures. The (correlated) color temperature of the light source is then the temperature of the black radiator whose color location is closest to the color location of the light source.

If, on the other hand, it is determined in step S120 that the state of the separate storage region does not change from an open state to the closed state, the light source arrangement continues to emit unchanged in step S190, that is to say it emits light with the same spectral characteristic, that is to say the same correlated color temperature, as previously. Alternatively, the light source arrangement can be activated in such a manner that the correlated color temperature is 4000 K.

An example of three color value groups with different color value ranges is mentioned as an example in the following. The first color value group comprises color values, that is to say values for the hue in the HSV color space, which lie in the range from 18° inclusive to 157.5° inclusive (green-yellow) and in the range from 279° inclusive to 324° inclusive. The second color value group comprises color values which lie in the range from 0° to 18° (red) and in the range from 342° inclusive to 360° (red). Finally, the third color value group comprises all the color values that are not included in the first and second color value groups, as well as the color value 0. The correlated color temperature allocated to the first color value group is, as described in relation to FIG. 6, 3000 K, the correlated color temperature allocated to the second color value group is 2500 K, and the correlated color temperature allocated to the third color value group is 4000 K.

In order that the color value can reliably be used according to the above-described method to specify the correlated color temperature of the light source, the color rendering index (CRI) of the light source should be at least 90. The color rendering index is a characteristic number which describes the quality of the color rendering of light sources of the same correlated color temperature.

By means of the above-described method it is possible, for example, to light fish and seafood stored in the cold compartment with white light with a correlated color temperature of 4000 K, fruit and vegetables as well as cheese and other fresh dairy products with light with a correlated color temperature of 3000 K, and bread and baked goods with light with a correlated color temperature of 2500 K, without the object as such, that is to say the type of food, being determined directly, but only via the hue of the light emitted, that is to say reflected or scattered, by the lit foods. In particular, it is possible, according to the contents of the cold compartment, to set the "hue" for the illuminating light automatically, so that the foods appear as appealing as possible to the user. Consequently, it is possible to adapt the correlated color temperature of the illuminating light to the contents of the cold compartment without having to determine the contents themselves.

According to one embodiment, the conversion of the color defined by the three color values in the RGB color space into the HSV color space, or the determination of the hue value on the basis of the RGB color values, is carried out by the following formula:

$$\mathrm{HUE}=60*(h+[\varphi/\mathrm{Max}(R;G;B)-\mathrm{Min}(R;G;B]). \quad (1)$$

In the formula

Max(R;G;B) is the maximum, that is to say the largest numerical value, of the red value (R), the green value (G) and the blue value (B) of the RGB color space; and Min(R;G;B) is the minimum, that is to say the smallest numerical value, of the red value (R), the green value (G) and the blue value (B) of the RGB color space.

The values for h and φ are determined according to which of the color values of the RGB color space is the greatest.

If Max(R;G;B) is the R value, then h=0.0 and φ=G−B.

If Max(R;G;B) is the G value, then h=2.0 and φ=B−R.

If Max(R;G;B) is the B value, then h=4.0 and φ=R−G.

If the hue value so calculated is less than 0, then that value $\mathrm{hue}_{calc}$ is increased by 360, that is to say Hue (if $\mathrm{HUE}_{calc.}<0$) $=\mathrm{HUE}_{calc.}+360$.

Thus, by way of example, in the case where R=180, G=75 and B=113:

HUE=60*(0.0+[75−113)/180−75)]))=−21.7143, and since this calculated value is less than 0:

HUE=−21.7143+360=338.2857°.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic refrigeration device, comprising:

an interior for storing foods;

a light source arrangement which is configured to emit light, in particular white light, of different spectral characteristics into the interior onto the stored foods therein; and a sensor unit which is configured to optically detect light reflected by the stored foods within the lit interior, to allocate to the reflected light a color value that is characteristic of the color of the reflected light, and to control the light source arrangement;

wherein the controlled light source arrangement is configured to thereafter exude an adjusted light of a specific spectral characteristic, which is dependent on the color value that is characteristic of the color.

2. The domestic refrigeration device according to claim 1, wherein the color value that is characteristic of the color of the emitted light is a value for the hue of the emitted light in HSV color space.

3. The domestic refrigeration device according to claim 1, wherein the light emitted by the light source arrangement is white light with different correlated color temperatures.

4. The domestic refrigeration device according to claim 1, wherein the light source arrangement is configured to emit light into a partial volume of the interior that is in the form of a separate storage region.

5. The domestic refrigeration device according to claim 4, wherein the separate storage region can be brought from a closed state into an open state and vice versa, and wherein the sensor unit further comprises a position sensor for detecting the closed state and the open state of the separate storage region.

6. The domestic refrigeration device according to claim 5, wherein the separate storage region is a cold compartment, in particular for fresh foods, which is arranged to be displaceable between an open state and a closed state, wherein in the closed state of the cold compartment a base plate on which the light source arrangement and the sensor unit are provided is arranged above an open side of the cold compartment and spaced apart from the open side of the cold compartment.

7. The domestic refrigeration device according to claim 4, wherein the separate storage region is a cold compartment, in particular for fresh foods, which is arranged to be displaceable between an open state and a closed state, wherein in the closed state of the cold compartment a base plate on which the light source arrangement and the sensor unit are provided is arranged above an open side of the cold compartment and spaced apart from the open side of the cold compartment.

8. The domestic refrigeration device according to claim 7, wherein the light source arrangement is arranged along a longitudinal direction of the base plate narrow side and inclined relative to the base plate narrow side in the direction towards the separate storage compartment, and wherein the base plate narrow side is in particular an end face of the base plate.

9. The domestic refrigeration device according to claim 8, wherein the sensor unit is arranged on a base plate flat side facing the cold compartment.

10. The domestic refrigeration device according to claim 7, wherein the sensor unit is arranged on a base plate flat side facing the cold compartment.

11. The domestic refrigeration device according to claim 7, wherein the base plate has a screen into which the light source arrangement is integrated.

12. The domestic refrigeration device according to claim 1, wherein the light source arrangement has a plurality of light-emitting diodes, LEDs, which emit light of different wavelengths.

13. The domestic refrigeration device according to claim 12, wherein the sensor unit comprises a light sensor which is sensitive in the different wavelengths.

14. The domestic refrigeration device according to claim 1, wherein the sensor unit comprises a micro-camera for optically detecting the lit interior.

15. A method of controlling a light source arrangement in a domestic refrigeration device which comprises an interior for storing foods, a light source arrangement configured to emit light, in particular white light, of different spectral characteristics into the interior onto the stored foods within, and a sensor unit which is configured to optically detect a color hue of a light reflected by the stored foods within the lit interior, the method comprising:

lighting the interior by means of the light source arrangement with light, in particular white light;

optically detecting the reflected light from the stored foods within the lit interior;

determining a color value that is characteristic of the color of the reflected light;

controlling the light source arrangement in such a manner so as to exude an adjusted light of a specific spectral characteristic, which is dependent on the determined color value that is characteristic of the color.

16. The method according to claim 15, wherein the determined color or value that is characteristic of the color of the reflected light is a color value for the hue of the reflected light in HSV color space.

17. The method according to claim 16, further comprising:

allocating the determined value for the hue to one of a plurality of color value groups, wherein a color value group in each case comprises one or more color value ranges, each color value group having color value ranges which are different from one another, and wherein each color value group is in turn allocated to a specific correlated color temperature; and controlling the light source arrangement such a manner that the adjusted light is exuded a correlated color temperature that corresponds to the specific correlated color temperature allocated to the color value group to which the determined value for the hue was allocated is exuded.

18. The method according to claim 15, wherein the lit interior is a partial volume of the interior in the form of a separate storage region, wherein the separate storage region can be brought from a closed state into an open state and vice versa, and wherein the closed state and the open state can be detected by means of a position sensor, and wherein the method according to claim 15 is started only when the closed state is detected by means of the position sensor after a predetermined time period following the open state.

19. The method according to claim 18, wherein the light source arrangement comprises a plurality of light sources, in particular light-emitting diodes, LEDs, which emit light of different wavelengths, and a sensor unit having a light sensor which is sensitive in the different wavelengths, wherein the light sources, when the method according to claim 15 is started, are controlled in such a manner that they emit light of different wavelengths temporally in succession for lighting the interior.

20. A domestic refrigeration device, comprising:

an interior for storing foods;

a light source arrangement which is configured to emit light, in particular white light, of different spectral characteristics into the interior; and a sensor unit which is configured to optically detect light emitted by the lit interior, to allocate to the detected light a value that is characteristic of the color of the emitted light, and to control the light source arrangement in such a manner that light of a specific spectral characteristic, which is dependent on the value that is characteristic of the color, is emitted;

wherein the light source arrangement is configured to emit light into a partial volume of the interior that is in the form of a cold compartment, in particular for fresh foods, which is arranged to be displaceable between an open state and a closed state; and wherein in the closed state of the cold compartment a base plate on which the light source arrangement and the sensor unit are provided is arranged above an open side of the cold compartment and spaced apart from the open side of the cold compartment.

* * * * *